United States Patent [19]

Sotani et al.

[11] Patent Number: 4,803,343

[45] Date of Patent: Feb. 7, 1989

[54] ELECTRIC FLUID HEATING APPARATUS UTILIZING A VAPORIZABLE WORKING FLUID

[75] Inventors: Junji Sotani, Yokohama; Tatsuya Koizumi; Shiro Endo, both of Tokyo; Nobuyoshi Mashino, Hidaka; Susumu Seo, Yokohama, all of Japan

[73] Assignees: The Furukawa Electric Co., Ltd.; The Furukawa Construction Co., Ltd., both of Tokyo, Japan

[21] Appl. No.: 945,716

[22] Filed: Dec. 23, 1986

[30] Foreign Application Priority Data

| | | | |
|---|---|---|---|
| Dec. 26, 1985 | [JP] | Japan | 60-297183 |
| Mar. 20, 1986 | [JP] | Japan | 61-63333 |
| Mar. 20, 1986 | [JP] | Japan | 61-63334 |

[51] Int. Cl.[4] ..... H05B 3/82; F28D 15/02; F22B 1/28; F24H 1/20

[52] U.S. Cl. ..... 219/326; 126/377; 165/104.21; 219/430; 219/439

[58] Field of Search ..... 219/325, 326, 365, 341, 219/430, 439, 314–316, 318, 540, 530, 523; 165/104.21; 126/376–379

[56] References Cited

U.S. PATENT DOCUMENTS

| | | | |
|---|---|---|---|
| 983,548 | 2/1911 | Gale | 219/314 |
| 1,503,972 | 8/1924 | Berg | 219/326 |
| 1,596,869 | 8/1926 | Claret | 219/326 X |
| 2,328,210 | 8/1943 | Groen | 219/430 |
| 2,439,617 | 4/1948 | Belgau | 219/326 |
| 3,686,040 | 8/1972 | Grover et al. | 219/326 X |
| 3,854,454 | 12/1974 | Lazaridis | 219/326 X |
| 4,377,737 | 3/1983 | Berry | 219/326 X |
| 4,554,966 | 11/1985 | Vasiliev et al. | 219/326 |
| 4,631,388 | 12/1986 | Manning | 219/530 X |

FOREIGN PATENT DOCUMENTS

| | | | |
|---|---|---|---|
| 465781 | 6/1950 | Canada | 219/326 |
| 1155892 | 10/1963 | Fed. Rep. of Germany | 219/439 |
| 526760 | 8/1976 | U.S.S.R. | 165/104.21 |
| 605905 | 8/1948 | United Kingdom | 219/326 |

OTHER PUBLICATIONS

Anon., "Storage Tank Heating System by Furukawa MIC Method", Furukawa Electric Co., Ltd., Tokyo Japan (1982).

*Primary Examiner*—Anthony Bartis
*Attorney, Agent, or Firm*—Armstrong, Nikaido, Marmelstein & Kubovcik

[57] ABSTRACT

An apparatus for heating fluid in a storage tank or transport pipe includes a elongated horizontally positioned tubular receiver having a cover plate at one end thereof through which an electric cartridge heater is inserted into a lower portion of the receiver. A vaporizable working fluid partially fills the lower portion of the receiver to a level sufficient to cover the heater and a temperature detector for controlling the heater is inserted through the cover plate into the receiver above the level of the fluid therein. A sealed tubular heat exchanger communicates with the receiver through a single passage through which vaporized working fluid enters the heat exchanger and condensed working fluid's returned to the receiver and the receiver and heat exchanger are evaculated of gasses. The heat exchanger may be disposed whithin a container holding fluid to be heated or constitute a jacket disposed around the container.

5 Claims, 6 Drawing Sheets

ELECTRIC FLUID HEATING APPARATUS UTILIZING A VAPORIZABLE WORKING FLUID

BACKGROUND OF THE INVENTION

The present invention relates to a heating apparatus for liquids or gases wherein the viscosity rises significantly at a lower temperature or wherein maintenance at a proper temperature is necessary for a certain purpose.

Such fluids as described require heating to a temperature higher than a fixed value in the storage tank, on the way through transporting pipe line, etc.

The most frequently used equipment among the conventional heating equipments is one shown in FIG. 11. In this conventional equipment, a heat transfer pipe 8 made from steel pipe is provided inside the storage tank 9 in a way that one end is protruded from said tank 9 and an inner cylinder 82 filled with rock wool 81 is inserted into this heat transfer pipe 8. On the outer circumference of this inner cylinder 82, MI cable (nonadhering insulated heating cable) 83 is wound spirally and densely and, in the space between MI cable 83 and heat transfer pipe 8, alumina 84 is filled to make the heat resistance low between the cable 83 and the heat transfer pipe 8. When charging MI cable 83 with electricity, Joule heat generated is transmitted to the oils in storage tank through the filled layer of alumina 84 and the heat transfer pipe 8. Numeral 91 is a flange for fitting and numeral 85 is a connection box in FIG. 11.

With the heating equipment above, the handling is easy at the time of running, but, at the time of breakdown, the whole equipment mainly composed of heat transfer pipe 8 must be exchanged. Since all of the contents of the tank must be removed for the exchange of the heater, there was a problem in coping with the breakdown. Moreover, it is the present status that, even if alumina is filled between the heat transfer pipe and MI cable, the heat resistance is still high resulting in that the temperature of MI cable becomes high and the limit on heating temperature of the heating apparatus is considerably lower than the tolerance temperature of MI cable. Furthermore, there were problems that the output of the heating apparatus and the length of heat transfer pipe are restricted by the output and the length of MI cable making the apparatus unsuitable for the storage tank of large capacity, and so on.

The purpose of the invention is to improve the aforementioned problems of the conventional heating, that is, to provide a heating apparatus wherein the maintenance work at the time of breakdown etc. is simple, the output and heating temperature can be established without any restriction by the cable insulation etc., the apparatus can be installed to the center of the container even when heating tanks of large capacity and, at the same time, the equipment can be installed in low cost.

SUMMARY OF THE INVENTION

The invention is one carrying out the heating of fluids by utilizing thermosiphon principle. The first practical embodiment is a thermosiphon having an operation section at one side which is provided inside the storage tank or transport pipe of fluid in such a way that said thermosiphon lies horizontally or inclines downwardly to the operation section and that the operation section appears outside said tank or pipe, a receiver section for a working fluid is formed at the bottom of said thermosiphon on the side of operation section, a degassing pipe is inserted from the outside of the vessel into said thermosiphon, and the working fluid in the receiver section is heated and evaporated by the heating means. The second practical embodiment is an apparatus wherein the receiver section of working fluid is separated from the thermosiphon and a receiving vessel of working fluid is installed outside or inside said tank or pipe so that the working fluid flows into the thermosiphon and the receiving vessel. Further, the third practical embodiment is that in which at least the circumferential side wall of said tank or pipe is formed doubly through a fixed spatial layer, at the same time, said spatial layer is communicated to the thermosiphon so that the condensed fluid generated in the spatial layer can flow into the thermosiphon, and the working fluid in the thermosiphon is heated and evaporated.

BRIEF DESCRIPTION OF THE DRAWING

FIG. 1 through FIG. 3 are concerned in the first practical embodiment of the invention, wherein FIG. 1 is a partially abbreviated cross section showing one example of heating apparatus, FIG. 2 is a partially abbreviated cross section of necessary portion showing the thermosiphon in another example, and FIG. 3 is an approximate ground plan exemplifying the heating apparatus used in the thermosiphon shown in FIG. 2.

FIG. 4 through FIG. 7 are concerned in the second practical embodiment of the invention, wherein FIG. 4 is a partially abbreviated cross section showing one example of heating apparatus, FIG. 5 is a partially abbreviated cross section of necessary portion showing the thermosiphon in another example, FIG. 6 is an approximate side view exemplifying the heating apparatus used in the thermosiphon shown in FIG. 5, and FIG. 7 is a partially abbreviated cross section showing further different example.

FIG. 8 through FIG. 10 show the third practical embodiment of the invention, wherein FIG. 8 is a partially abbreviated cross section showing one example of heating apparatus, FIG. 9 is a partially abbreviated and expanded cross section of the thermosiphon in the example in FIG. 8, and FIG. 10 is a cross section exemplifying another embodiment of the apparatus.

DETAILED DESCRIPTION OF THE INVENTION

Figure 1:
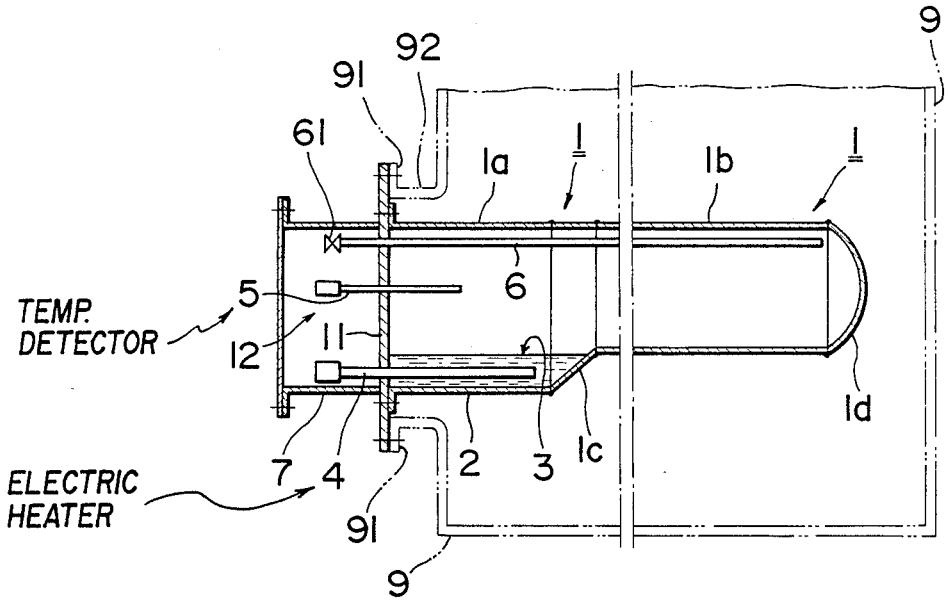

The invention provides a heating apparatus utilizing a thermosiphon in which the latent heat is given and received through the evaporation and the condensation of a working fluid, and the principle of a heat pipe is applied ingeniously in the invention. Through the evaporation of working fluid, the latent heat of evaporation is transferred to the whole thermosiphon or further to a spatial layer provided on the circumferential side wall of the container, the fluid being therein, to warm the fluid contacted therewith and simultaneously the condensed fluid of the vapor of working fluid circulates to the receiver section of working fluid installed inside or outside of thermosiphon and is heated to evaporate again. In this way, by repeating the exchange of the latent heat of evaporation, the fluid in the storage tank or the transport pipe is heated.

The working fluid to be placed in the thermosiphon is selected appropriately depending on the temperature at which the fluid to be heated is kept. As the combinations of such working fluids with the temperature to heat and keep the fluid to be heated, which is shown in parentheses, water (50°-150° C.), water containing an inhibitor, Freon (−10°-50° C.), naphthalene (150°-220° C.), toluene (60°-150° C.), diphenyl (150°-200° C.), mixture of diphenyl with diphenyl ether (150°-260° C.), etc. can be exemplified, but any medium fluid can be used besides of above, if it evaporates in the vicinity of a fixed working temperature, it is excellent in the thermal stability and it has high transfer rate of heat of evaporation and condensation.

The heating of working fluid is made directly by immersing, the heating means into working fluid or indirectly by heating the receiver section or the receiving vessel of working fluid of the thermosiphon from outside of the thermosiphon. For the heating means, a heating pipe containing a heating medium may be used in addition to an electric heater. For the heating means consisting of a cartridge heater, it is desirable from the point of safety to provide a thermocouple and to shut off the power source connected to the heating means when the temperature of heating means reaches a fixed value through the dry up of working fluid, generation of noncondensing gas or the like. Moreover, for the heating means consisting of cartridge heater, it is desirable to provide a screw portion on the cover or end plate and to fit the heating means thrusting into the receiver section of working fluid in order to make the exchange easier at the time of breakdown.

In the thermosiphon, a temperature detector indicating the temperature of vapor is provided. By controlling said heating means based on the measured value of the temperature in the thermosiphon through this one-point temperature detection, the temperature in thermosiphon is kept constant over time.

Furthermore, in the thermosiphon, a thin degassing pipe is provided. One end of this pipe inside the thermosiphon is opened and the other end protruding through the side of the operation section is closed tightly by means of a valve or other means. This degassing pipe is fitted so that the opening portion is kept at a distance as far as possible from the receiver section of working fluid. Thus, when the noncondensing gas etc. accumulates in the thermosiphon, it becomes possible to remove the accumulated gas by opening the end of the degassing pipe at the side of operation section.

The heat transfer pipe of a thermosiphon is not limited to the steel pipe made from carbon steel, but stainless steel pipe, pipes made from copper or alloys thereof, pipes made from aluminum or the alloys thereof, flexible pipe, ceramic pipe and other materials which tolerate the working temperature can be used. Pipes with fins may also be used.

The fluids to which the heating equipment of the invention can be applied extend over an extremely wide range. The equipment has been applied to, for example, oils such as Minas crude oil, C-grade heavy oil, lubricating oil, edible oil, etc., various raw materials, intermediates and products such as water, sulfuric acid, caustic soda, phenol, paraffin, urea, sulfur, metallic sodium, asphalt, pitch, tar, chocolate, butter, margarine, TDI, MDI, Varnish, ink, etc., further, air, LPG, chlorine gas, sulfur dioxide, and the like to obtain excellent results.

The invention will be illustrated in more detail based on the examples shown in the drawings.

EXAMPLE 1

In FIG. 1, numeral 9 indicates the storage tank of oils, and an aperture 92 with a flange 91 is formed on the side face.

Numeral 1 is the thermosiphon which has the operation section 12 on one side and in which the receiver section 2 to accumulate the working fluid 3 is formed at the bottom on the side of said operation section 12. In this example, a short pipe 1*a* with large diameter and a principal pipe 1*b* with small diameter, both consisting of the steel pipes made from carbon steel, are welded through a reducing joint 1*c*, and a cap 1*d* is welded to the tip of the principal pipe 1*b*.

This thermosiphon 1 is positioned so that the operation section 12 including the heating means 4 etc. appears outside the tank 9 and the thermosiphon 1 protrudes approximately horizontally from said aperture 92 of the tank 9 toward the inside or inclines slightly downward to the side of operation section 12 where the receiver section 2 is provided, and fitted by fixing the outer circumference of a cover 11 to close the side of aperture against the flange 91. If necessary, the thermosiphon 1 may be supported in the tank 9 by the appropriate supporting members (not shown in the drawing).

Accordingly, when the condensed fluid is generated inside the thermosiphon 1, it can flow naturally into the receiver section 2 of working fluid 3.

In the receiver section 2 of working fluid 3, the heating means 4 consisting of cartridge heater is provided passing through the cover 11 and, by this heating means 4, the working fluid 3 in the receiver section 2 is heated and evaporated.

Numeral 5 is the temperature detector provided in said thermosiphon 1 passing through the cover 11 and numeral 6 is the thin degassing pipe provided so as to reach to the deepest upper portion in the thermosiphon 1 passing through the cover 11. Through the cover 11, a supply port (not shown in the drawing) is provided in the vicinity of the receiver section 2 of working fluid 3 to supply the working fluid 3. Numeral 7 is a connection box provided for covering of the operation section 12 including heating means 4, temperature detector 5, valve 61, etc.

According to the heating equipment in the example aforementioned, the working fluid 3 in the receiver section 2 heated by the heating means 4 is evaporated to reach to whole portion inside the thermosiphon 1, the latent heat thereof is transferred to the oils in the storage tank 9 through the thermosiphon 1, and the working fluid condensed by releasing the latent heat returns to the receiver section 2. Through such repetition of exchange of latent heat, the oils in the tank 9 are heated to appropriate temperature.

When the tank 9 has large capacity, a plurality of thermosiphons 1 as described above can be provided at regular intervals directed circumferentially or vertically in tank 9 in the state aforementioned.

Figure 2:
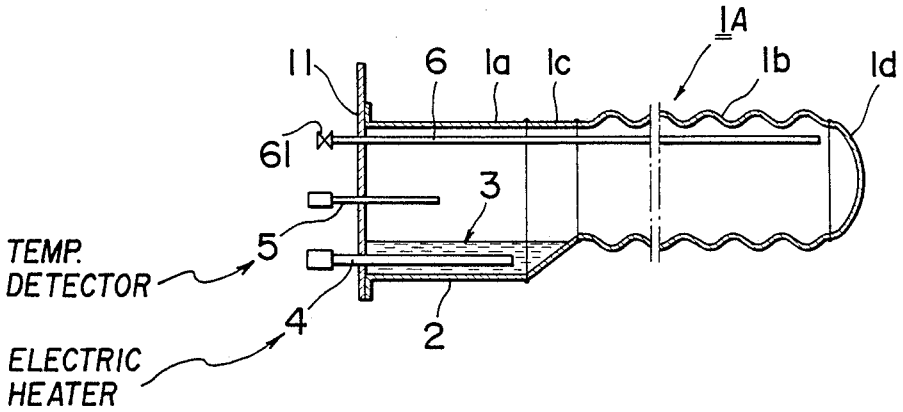

FIG. 2 shows other example, wherein a pipe with large diameter 1*a* and a principal pipe with small diameter 1*b* consisting of approximately corrugated flexible pipe are welded through a reducing joint and a cap 1*d* is welded to the tip of the principal pipe 1*b* to construct the thermosiphon 1A. With the thermosiphon 1A in this example, the condensed fluid is accumulated at the inside bottom of the principal pipe with small diameter 1*b*, but it flows into the receiver section 2 when accumulated in more than a fixed amount.

Figure 3:
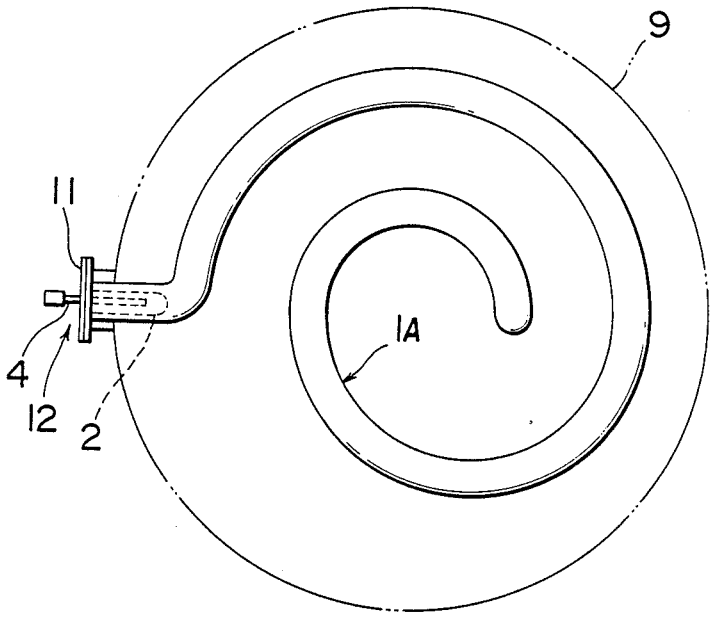

The thermosiphon in FIG. 2 is suitable for installation of the principal pipe 1*b* in a spiral loop in the tank 9 as shown in FIG. 3 or for installation on the principal pipe 1*b* so as to rise upwardly and spirally in the tank. The functional effect in such configuration is same as that of the equipment of the example in FIG. 1.

EXAMPLE 2

Figure 4:
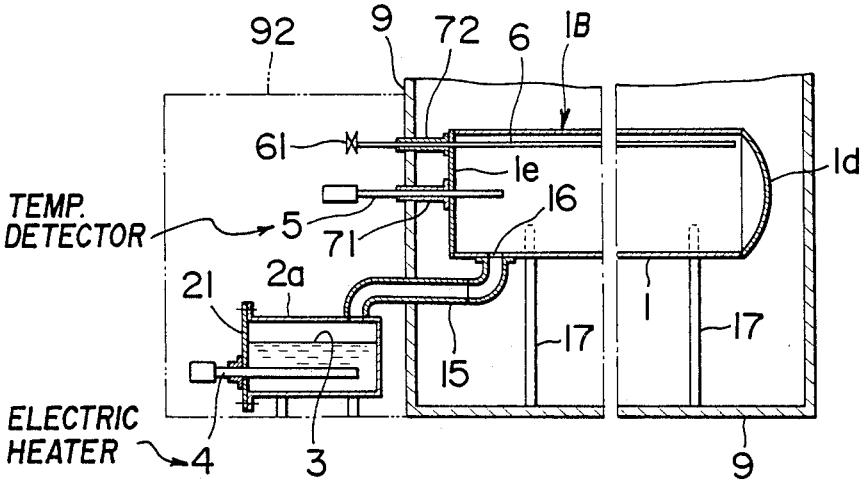

In FIG. 4, numeral 9 indicates the storage tank for oils, and the thermosiphon 1B having a vent 16 on the bottom face is provided in this tank 9 being supported by legs 17.

The thermosiphon 1B is constructed by welding an end plate 1*e* to one end and a cap 1*d* to other end of the steel pipe made from carbon steel, and the posture of this thermosiphon 1B is oriented so that the condensed fluid generated in said thermosiphon 1 flows to the direction of the vent 16 aforementioned. Namely, the thermosiphon 1 is installed horizontally as in this example, or in the inclined state downward to the direction of the vent 16 aforementioned.

Numeral 2*a* is the receiving vessel in which the working fluid 3 resides. On the upper face, this receiving vessel communicates to the portion of vent 16 of said thermosiphon 1 through a pipe 15 so that the vapor of working fluid 3 generated in the receiving vessel 2*a* enters into the thermosiphon 1 through this pipe 15 and the condensed fluid generated in the thermosiphon 1 flows down into the receiving vessel 2*a* through this pipe 15. At appropriate portion of this receiving vessel 2*a*, a supply port (not shown in the drawing) is provided to supply the working fluid 3.

In the receiving vessel 2*a* of working fluid 3, the heating means 4 consisting of cartridge heater is provided passing through the end wall 21 and, by this heating means 4, the working fluid 3 in the receiving vessel 2*a* is heated and evaporated. The heating means can also be fitted outside the receiving vessel 2*a* of working fluid 3.

Numeral 5 is the temperature detector provided in said thermosiphon 1 passing through the end plate 1*e* and the side wall of tank 9. This is inserted into the thermosiphon 1 through a guide 71 which is pipe-like and serves also as a cover, one end thereof being welded to the end plate 1*e* while other end thereof passing through the side wall of tank 9. Numeral 6 is the thin degassing pipe provided so as to reach to the deepest upper portion in thermosiphon 1B passing through the end plate 1*e* and the side wall of tank 9. This is inserted into the thermosiphon 1B through a guide 72 which is pipe-like and serves also as a cover, one end thereof being welded to the end plate 1*e* while other end thereof passing through the side wall of tank 9.

Numeral 92 is a connection box provided for covering of the operation section including receiving vessel 2*a*, heating means 4, temperature detector 5, valve 61, etc.

According to the heating apparatus in the example aforementioned, the working fluid 3 in the receiving vessel 2*a* heated by the heating means 4 is evaporated to fill the thermosiphon 1B, the latent heat thereof is transferred to the oil in the storage tank 9 through the thermosiphon 1B and the working fluid condensed by releasing the latent heat returns to the receiving vessel 2*a* through the pipe 15. Through such repetition of the exchange of latent heat, the oil in the tank 9 is heated to the appropriate temperature.

When the tank 9 has large capacity, a plurality of thermosiphons 1B as described above can be provided at regular intervals toward the circumferential or vertical direction of tank 9 in the state aforementioned.

Moreover, if the orientation of thermosiphon 1B and pipe 15 is established so that the condensed fluid generated in the thermosiphon 1B flows into the receiving vessel 2*a* through the pipe 15, the location of the vent 16 of thermosiphon 1B is not limited to that in the example aforementioned, and putting into practice is also possible even if provided, for example, at the lower portion of the end plate 1*e* or the cap 1*d*.

Figure 5:
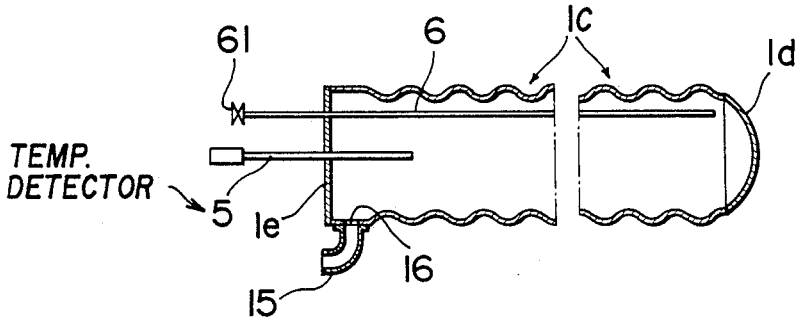

The thermosiphon 1C, which does not use the straight pipe as in the example aforementioned but uses a flexible pipe formed approximately in the corrugated shape as shown in FIG. 5, the end plate 1*e* and the cap 1*d* being welded to both ends thereof, can also be put into practice. With the thermosiphon 1C in the example in FIG. 5, the condensed fluid is accumulated at the inside bottom, but it flows into the receiving vessel 2*a* when accumulated more than a fixed amount.

Figure 6:
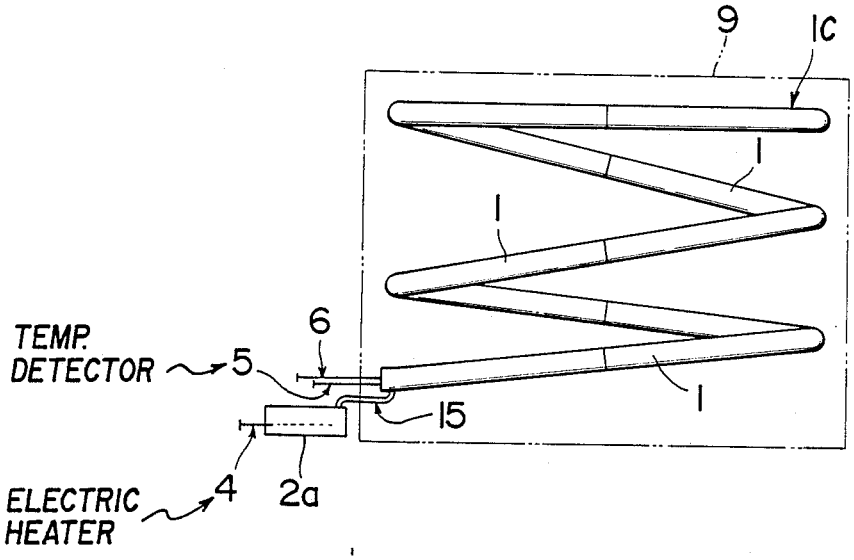

The thermosiphon in FIG. 5 is suitable for installation spirally toward vertical direction in the tank 9 as shown in FIG. 6 or to install spirally in the tank 9, and the functional effect in such configuration is approximately same as that of the equipment in the example in FIG. 4.

Figure 7:
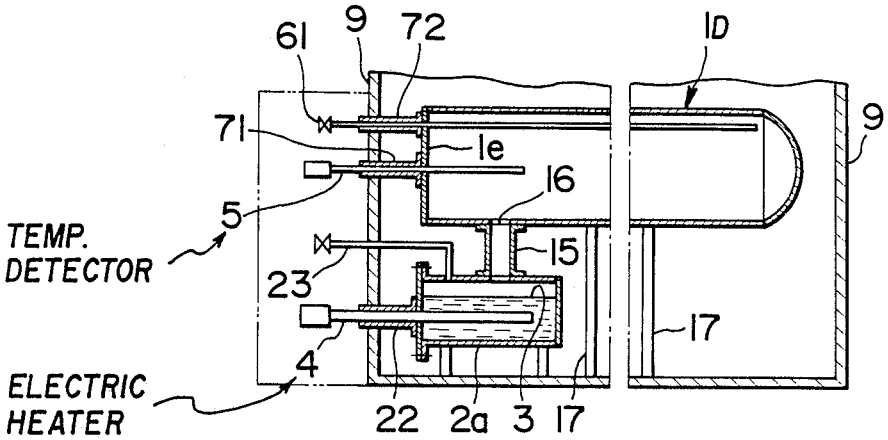

In each example above, putting into practice is also possible even if the receiving vessel 2*a* of working fluid 3 is installed inside the tank 9 as shown in FIG. 7. In the example in FIG. 7, the receiving vessel 2*a* is positioned under the thermosiphon 1D, the thermosiphon 1D and the receiving vessel 2*a* are communicated by a straight pipe 15, and the heating means 4 consisting of cartridge heater is inserted changeably from outside the tank 9 into the receiving vessel 2*a* through a guide 22 which is pipe-like and serves also as a cover so that the heating means 4 can be operated from outside the tank 9. Numeral 23 in the same drawing indicates a supply pipe provided for supplying the working fluid 3. This is provided so as one end and thereof to communicate to the receiving vessel 2*a* while other end to protrude from the tank 9. The functional effect of this example in FIG. 7 is also similar to that of the example in FIG. 4.

EXAMPLE 3

Figure 8:
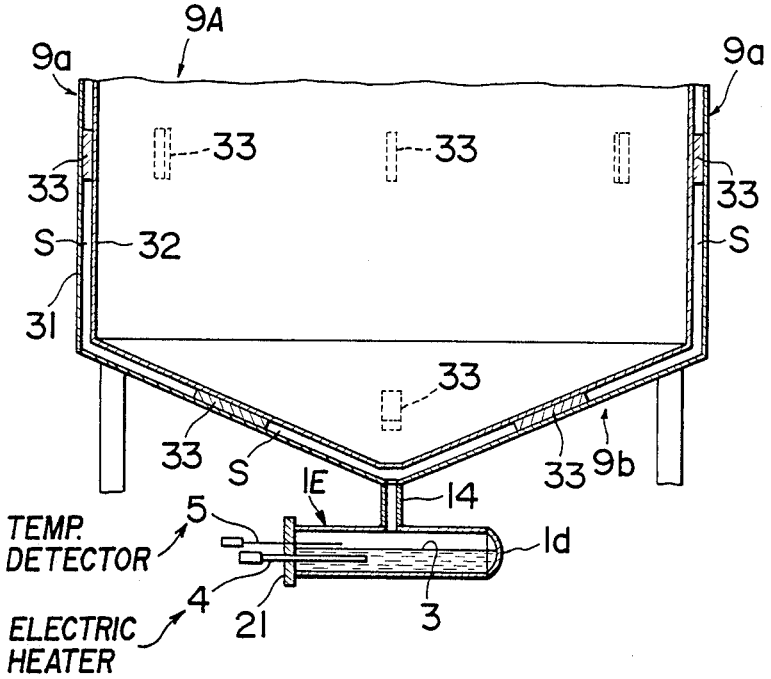
Figure 9:
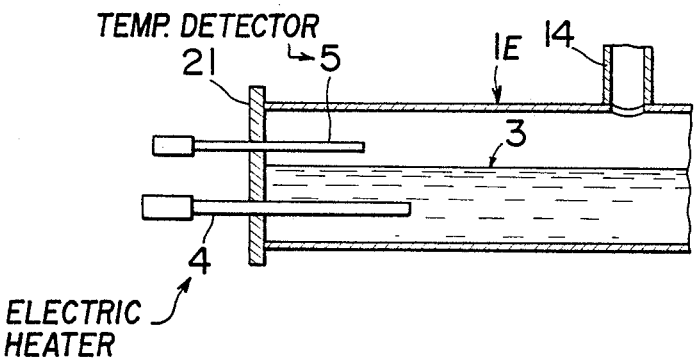

In FIG. 8 and FIG. 9, numeral 9A indicates a container of oil which is a tank. Tank 9A is constructed with outer tank 31 and inner tank 32 which has similar configuration to outer tank 31 and is smaller than outer tank 31. The outer tank 31 and the inner tank 32 are fixed to each other by the spacers 33 placed at appropriate positions on the circumferential wall portion at regular distances toward circumferential direction to make the circumferential side wall 9*a* and the bottom wall 96 of tank 9A jacketed structure leaving a fixed spatial layer S therebetween. It is preferable to give a heat-insulating finish (not shown in the drawing) to the outer circumferential face of outer tank 31 in order to prevent or suppress the radiation of heat in the spatial layer S toward outside.

Although the upper end of said spatial layer S is not shown in the drawing it is closed, and a switchable degassing port (not shown in the drawing) is provided to remove gas if necessary when the noncondensing gas etc. are accumulated in said spatial layers.

Numeral 1E is the receiving vessel for the thermosiphon in which the working fluid 3 is sealed, the end plate 21 being welded to one end while the cap 1*d* being welded to other end of straight pipe. The thermosiphon is installed approximately horizontally under the tank 9A aforementioned and communicated to said spatial layer S through a connecting pipe 14 so that the condensed fluid generated in the spatial layer S of tank 9A flows into the thermosiphon. It is desirable to cover the thermosiphon 1 with the heat-insulating material not shown in the drawing to prevent the heat radiation toward outside.

Into the receiving vessel 1E aforementioned, the heating means 4 consisting of cartridge heater is inserted passing through the end plate 21 and being immersed into the working fluid 3 and, by this heating means 4, the working fluid 3 in the receiving vessel 1E is heated and evaporated. The heating means 4 can also be fitted outside the receiving vessel 1.

Numeral 5 is the temperature detector inserted into the receiving vessel 1E aforementioned passing through the end plate 21, and the temperature in the thermosiphon 1E and that in the spatial layer 3 of the tank as well is kept constant approximately.

According to the heating equipment in the example aforementioned, the working fluid 3 in the receiving vessel 1E heated by the heating means 4 is evaporated to fill the spatial layer S of the tank 9A, the latent heat thereof is transferred to the oils in the tank 9A, and the working fluid condensed by releasing the latent heat returns to the receiving vessel 1E through the pipe 14. Through such repetition of the give and receipt of latent heat, the oils in the tank 9A are heated to appropriate temperature.

When the tank 9A has large capacity, a plurality of thermosiphons as described above can be provided.

In the example aforementioned, the spatial layer S is formed also on the bottom wall 9*b* of the tank 9A. But, depending on the size of tank 9A, the spatial layer S may be formed only on the circumferential side wall 9*a* of the tank 9A to communicate this spatial layer S to the receiving vessel 1E.

Figure 10:
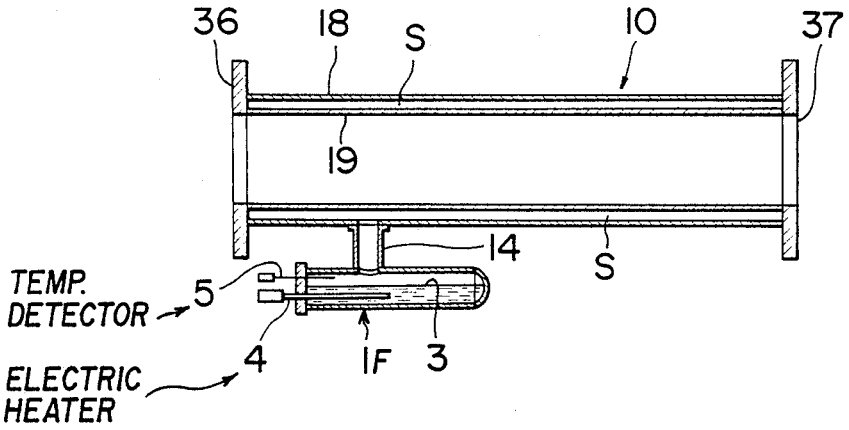
Figure 11:
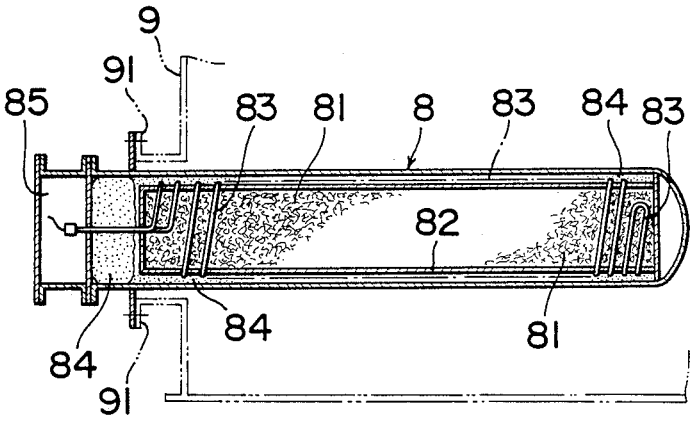
FIG. 11 PRIOR ART
FIG. 11 is a partially abbreviated cross section showing the conventional heating apparatus.

FIG. 10 shows another example of the invention, which is suitable for provision along a pipe line used for transporting fluids.

With the pipe 10 in FIG. 10, large and small pipes 18 and 19 are arranged doubly through a fixed spatial layer S, the flanges 36 and 37 being welded to both ends thereof. The spatial layer S aforementioned is connected to the receiving vessel 1F similar to that in preceding example through a connecting pipe 14 so that the condensed fluid generated in said spatial layer S flows into the receiving vessel 1F. It is desirable to provide a degassing port (not shown in the drawing) at the upper end portion of the pipe 10 similarly to the example aforementioned. Since the other constitution and the functional effect of the apparatus in this example are similar to those of the equipment in the example in preceding FIG. 8, the explanation thereof is omitted.

With each heating equipment described above, the structure is extremely simple, the installation can be made inexpensively, and, at the time of breakdown, the heating means 4 etc. can be repaired partially without replacing the whole apparatus. Moreover, there is no restriction by the constituting members. Therefore, it becomes possible to install the heating equipment of large capacity.

As evident from the explanation above, with the heating apparatus in accordance with the invention, the maintenance work on breakdown etc. is simple in the extreme, the output and the heating temperature can be established without being restricted by the cable etc. compared with the conventional apparatus, and, even when a large capacity is to be heated, the equipment fitted to the volume thereof can be installed. At the same time, the structure is simple, the installation can be made in low cost, and, in addition, the running cost becomes also low since the working fluid is enough is small amount and the energy for heating is also settled low.

What is claimed is:

1. A heating apparatus comprising:

(a) an elongated tubular receiver having a cover plate affixed to one end thereof, said receiver being positioned substantially horizontally;

(b) an electric cartridge heater inserted into a lower portion of said receiver through said cover plate;

(c) a vaporizable working fluid partially filling the lower portion of said tubular receiver to a level sufficient to cover said cartridge heater;

(d) a temperature detector inserted into said receiver through said cover plate at a location above the level of said working fluid;

(e) a sealed tubular heat exchange means in communication with said receiver through a single passage through which the vaporized working fluid flows from the receiver into the tubular heat exchange means and through which condensed working fluid from the tubular heat exchange means is returned to the receiver, said tubular heat exchange means having a surface in contact with a fluid to be heated;

(f) means for evacuating said sealed tubular heat exchange means and said receiver; and (g) means for energizing said cartridge heater in response to the temperature detected by said temperature detector;

wherein said working fluid transfers heat from said cartridge heater to said fluid to be heated by evaporation at said receiver and condensation on the surface of said sealed tubular heat exchange means.

2. The heating apparatus according to claim 1, wherein the said sealed tubular heat exchange means is a straight pipe.

3. A heating apparatus according to claim 1, wherein that portion of said tubular heat exchange means having a surface in contact with said fluid has a corrugated shape.

4. A heating apparatus according to claim 1, wherein said tubular heat exchange means is disposed within a container for said fluid in a spiral configuration.

5. A heating apparatus according to claim 1, wherein said tubular heat exchange means constitutes a jacket disposed around a tubular container, one surface of said tubular heat exchange means comprising at least a portion of the said tubular container.

* * * * *